US008691084B2

(12) United States Patent
McGrady et al.

(10) Patent No.: US 8,691,084 B2
(45) Date of Patent: Apr. 8, 2014

(54) BITUMEN UPGRADING USING SUPERCRITICAL FLUIDS

(75) Inventors: Gerard Sean McGrady, Lincoln (CA); Sarah Ann Brough, Fredericton (CA); Christopher Willson, Fredericton (CA)

(73) Assignee: University of New Brunswick, Fredericton, NB (CA)

( * ) Notice: Subject to any disclaimer, the term of this patent is extended or adjusted under 35 U.S.C. 154(b) by 609 days.

(21) Appl. No.: 12/663,843

(22) PCT Filed: Jun. 11, 2008

(86) PCT No.: PCT/US2008/066545

§ 371 (c)(1), (2), (4) Date: Sep. 13, 2010

(87) PCT Pub. No.: WO2008/154576

PCT Pub. Date: Dec. 18, 2008

(65) Prior Publication Data

US 2011/0049016 A1 Mar. 3, 2011

Related U.S. Application Data

(60) Provisional application No. 60/943,173, filed on Jun. 11, 2007.

(51) Int. Cl.
*C10G 1/00* (2006.01)

(52) U.S. Cl.
USPC ..... 208/400; 208/390; 208/391; 208/402; 208/407; 208/408; 208/424; 208/428; 208/435; 208/46; 208/142; 208/143

(58) Field of Classification Search
USPC ..... 208/390, 391, 400, 402, 407, 408, 424, 208/428, 435, 46, 142, 143
See application file for complete search history.

(56) References Cited

U.S. PATENT DOCUMENTS

| | | | | | |
|---|---|---|---|---|---|
| 3,853,749 | A * | 12/1974 | Espenscheid et al. | ..... | 208/307 |
| 4,397,736 | A * | 8/1983 | Low | ..... | 208/390 |
| 5,017,281 | A * | 5/1991 | Sadeghi et al. | ..... | 208/390 |
| 7,008,528 | B2 * | 3/2006 | Mitchell et al. | ..... | 208/390 |
| 2009/0011960 | A1 * | 1/2009 | Wu | ..... | 507/117 |

FOREIGN PATENT DOCUMENTS

| | | |
|---|---|---|
| WO | WO0039251 | 7/2000 |
| WO | WO0181239 | 11/2001 |
| WO | WO020866018 | 10/2002 |

OTHER PUBLICATIONS

ISR for PCT/US2008/066545 issued Oct. 13, 2008.

* cited by examiner

*Primary Examiner* — Prem C Singh
*Assistant Examiner* — Michelle Stein
(74) *Attorney, Agent, or Firm* — Milstein Zhang & Wu LLC; Joseph B. Milstein

(57) ABSTRACT

The invention provides systems and methods for extracting and upgrading heavy hydrocarbons from substrates such as oil sands, oil shales, and tar sands in a unitary operation. The substrate bearing the hydrocarbon is brought into contact with a supercritical or near-supercritical fluid, a source of hydrogen such as hydrogen gas, and a catalyst. The materials are mixed and heated under elevated pressure. As a consequence of the elevated temperature and pressure, upgraded hydrocarbon-containing material is provided in a single or unitary operation. In some embodiments, sonication can be used to improve the upgrading process. Fluids suitable for use in the process include carbon dioxide, hexane, and water. It has been observed that upgrading can occur within periods of time of a few hours.

19 Claims, 3 Drawing Sheets

BITUMEN UPGRADING USING SUPERCRITICAL FLUIDS

CROSS-REFERENCE TO RELATED APPLICATIONS

This application is a national stage application under 35 U.S.C. 371 of co-pending International Application PCT/US2008/066545, filed Jun. 11, 2008 and published as WO 2008/154576 A1, which designated the United States, and which claims priority to and the benefit of U.S. provisional patent application Ser. No. 60/943,173, filed Jun. 11, 2007, each of which applications is incorporated herein by reference in its entirety.

TECHNICAL FIELD

This invention relates to the extraction and upgrading of fossil fuels and in particular, the upgrading of bitumen using supercritical fluids.

BACKGROUND OF THE INVENTION

The Substrate

The Athabasca tar sands in Alberta are estimated to contain at least 1.7 trillion barrels of oil, and as such may represent around one-third of the world's total petroleum resources. Over 85% of known bitumen reserves lie in this deposit, and their high concentration makes them economically recoverable. Other significant deposits of tar sands exist in Venezuela and the USA, and similar deposits of oil shale are found in various locations around the world. These deposits consist of a mixture of clay or shale, sand, water and bitumen. Bitumen is a viscous, tar-like material composed primarily of polycyclic aromatic hydrocarbons (PAHs). Extraction of the useful bitumen in tar sands is a non-trivial operation, and many processes have been developed or proposed. Lower viscosity deposits can be pumped out of the sand, but more viscous material is generally extracted with superheated steam, using processes known as cyclic steam stimulation (CSS) or steam assisted gravity drainage (SAGD). More recently, this latter technology has been adapted to use hydrocarbon solvents instead of steam, in a vapor extraction (VAPEX) process. Supercritical fluids (SCFs) have been considered a potentially attractive extractant for bituminous deposits since the 1970s. Their low densities and low viscosities make them particularly effective at permeating tar sands and oil shales and extracting organic deposits, and the energy costs associated with the moderate temperatures and pressures required to produce them compare very favourably with those processes that use superheated steam. For example, bitumen has been successfully recovered from Stuart oil shale in Queensland using supercritical carbon dioxide ($scCO_2$), and from Utah oil sands using supercritical propane (sc propane). Very recently, Raytheon announced the use of $scCO_2$ in combination with RF heating to extract oil shale deposits beneath Federal land in Colorado, Utah and Wyoming.

Bitumen typically contains around 83% carbon, 10% hydrogen and 5% sulfur by weight, along with significant ppm amounts of transition metals like vanadium and nickel associated with porphyrin residues. This low-grade material commonly needs to be converted into synthetic crude oil or refined directly into petroleum products before it can be used for most applications. Typically, this is carried out by catalytic cracking, which redistributes the hydrogen in the material. Catalytic cracking produces a range of 'upgraded' organic products with relatively high hydrogen content, but leaves behind a substance known as asphaltene, which is even more intractable than bitumen and contains very little hydrogen. Unless this asphaltene is upgraded by reaction with hydrogen, it is effectively a waste product.

SUMMARY OF THE INVENTION

In one aspect, the invention relates to a process for extracting and upgrading a hydrocarbon. The process comprises the steps of providing a substrate containing a hydrocarbon comprising at least one of oil, tar and bituminous material to be extracted and upgraded; providing a reaction medium comprising hydrogen gas, a catalyst, and a supercritical or near-critical solvent that serves to extract the at least one of oil, tar and bituminous material from the substrate, and that serves to dissolve the hydrogen gas; mixing the substrate, supercritical or near-critical solvent, hydrogen gas, and the catalyst; and maintaining the mixture at temperature sufficient to cause reaction for a length of time calculated to allow said reaction to proceed to a desired extent. By this process, oil, tar or bituminous material is extracted and upgraded in a unitary operation.

In one embodiment, the process further comprises the step of providing a modifier. In one embodiment, the modifier is toluene or methanol. In one embodiment, the process further comprises the step of sonication. In one embodiment, the process further comprises the step of photochemical activation. In one embodiment, the hydrocarbon comprises at least one of bitumen and a polycyclic aromatic hydrocarbon (PAH). In one embodiment, the substrate comprises at least one of oil sand, oil shale deposits, and tar sand. In one embodiment, the PAH comprises at least one of naphthalene, anthracene, phenanthrene, pyrene, perylene, benzothiophene and indole. In one embodiment, the PAH contains nitrogen, sulfur, or a transition metal. In one embodiment, the supercritical or near-critical solvent is carbon dioxide.

In one embodiment, the catalyst comprises at least one of $Mn_2(CO)_8(PBu_3)_2$, $RuH_2(H_2)(PCy_3)_2$, Pd, Pt, Ru, Ni Rh, Nb, and Ta. In one embodiment, the process further comprises the step of providing a co-solvent. In one embodiment, the co-solvent is a selected one of n-butane and methanol. In one embodiment, the supercritical or near-critical solvent is a selected one of hexane and water. In one embodiment, the catalyst comprises at least one of $\alpha$-$Al_2O_3$, $HfO_2$, $ZrO_2$, NiMo, Fe, Ni, Ru, Ru, Pd, Pt, and Ir.

In some embodiments, the step of maintaining the mixture at temperature sufficient to cause reaction comprises maintaining the mixture at a temperature in the range of 50° C. to 400° C. In some embodiments, the step of maintaining the mixture at temperature sufficient to cause reaction comprises maintaining the mixture at a temperature in the range of 50° C. to 150° C. In some embodiments, the step of maintaining the mixture at temperature sufficient to cause reaction comprises maintaining the mixture at a temperature in the range of 250° C. to 350° C.

In some embodiments, the step of providing a reaction medium comprising hydrogen gas, a catalyst, and a supercritical or near-critical solvent comprises providing said supercritical or near-critical solvent at a pressure in the range of 50 bar to 1000 bar. In some embodiments, the step of providing a reaction medium comprising hydrogen gas, a catalyst, and a supercritical or near-critical solvent comprises providing said supercritical or near-critical solvent at a pressure in the range of 100 bar to 500 bar. In some embodiments, the step of providing a reaction medium comprising hydrogen gas, a catalyst, and a supercritical or near-critical solvent comprises providing said supercritical or near-critical solvent at a pressure in the range of 150 bar to 400 bar.

Combining the operations of extraction, distillation, coking and upgrading will allow for major cost savings in energy, capital equipment and plant and process management systems. It will also have the added advantage of permitting significant reductions in $CO_2$ emissions through increased efficiency.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
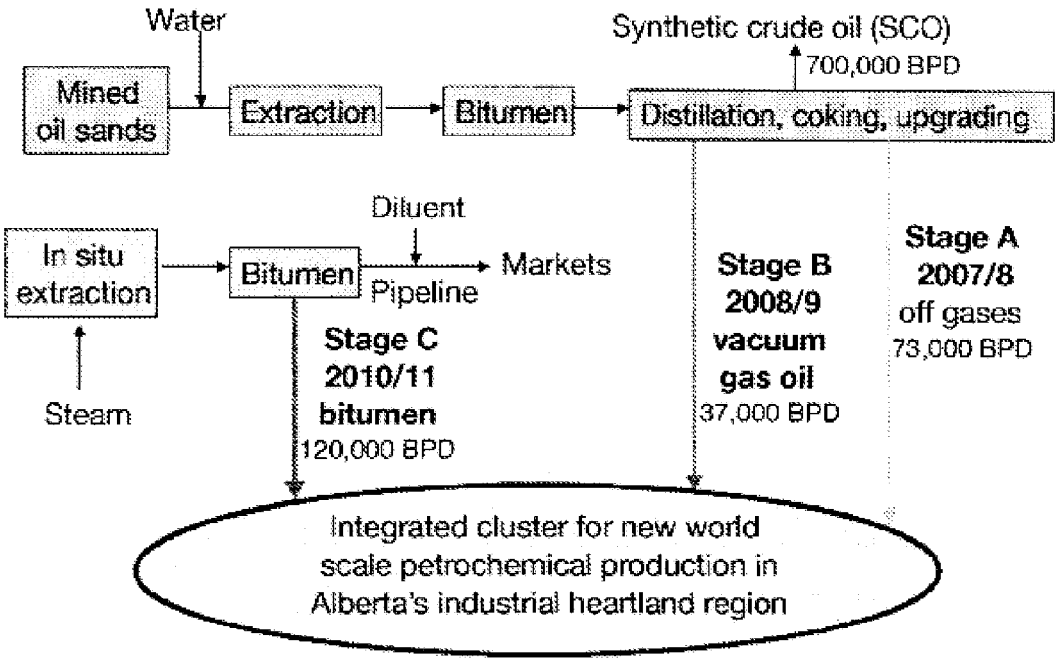
FIG. 1 is a schematic diagram of an oil sands petrochemicals process with integrated distillation, coking and upgrading.

This invention teaches a combined SCF process for extracting and upgrading bitumen, thereby enabling a more efficient and integrated procedure for use in the processing of low-grade petroleum deposits in tar sands and/or oil shales. While supercritical fluids have been used to extract oil and bituminous materials from sand and shale deposits, and have been used as reaction media for a range of homogeneous and heterogeneous chemical processes, they have never been used in the combined extraction/chemical reaction process of this invention. In this invention, mining or in situ extraction produces bitumen that feeds into a combined distillation, coking and upgrading process.

Solubility and Extraction of Bitumen in SCFs

Bitumen is a semi-solid material consisting of a mixture of hydrocarbons with increasing molecular weight and heteroatom functionalities. If bitumen is dissolved in hydrocarbons such as n-heptane, a precipitate known as asphaltene forms. This is the most complex component of crude oil, consisting of large PAHs. It has been shown that asphaltenes are soluble in toluene but insoluble in n-heptane at reasonable temperatures, which indicates that it is possible to form bituminous solutions. Solubilities of tar sand bitumen in $scCO_2$ have been reported at temperatures between 84° C. and 120° C. These studies reveal that its solubility is temperature- and pressure-dependent, with low temperatures and higher pressures giving optimum solubilities.

Supercritical Fluid Reaction Media

In addition to their excellent extraction properties, supercritical fluids have developed recently into unique and valuable reaction media, and now occupy an important role in synthetic chemistry and industry. They combine the most desirable properties of a liquid with those of a gas. These include the ability to dissolve solids and total miscibility with permanent gases. This is particularly valuable in the case of hydrogen, whose low solubility in conventional solvents is a major obstacle to synthetic chemists. For example, $scCO_2$ with 50 bar of added $H_2$ at 50° C. is 3 M in $H_2$, a concentration that cannot be reached in liquid benzene except at an $H_2$ pressure of 1000 bar.

Two US patents describe the application of SCFs to the upgrading and cracking of heavy hydrocarbons. U.S. Pat. No. 4,483,761 describes the addition of light olefins to an SCF solution, and U.S. Pat. No. 5,496,464 describes the hydrotreating of such a solution.

Carbon Dioxide, $CO_2$

With its low $T_c$, $P_c$, and cost, $CO_2$ has found many applications as a SCF medium for a range of processes. It is already established as an excellent extraction medium, and has demonstrated utility in the extraction of bituminous materials from tar sands and oil shale, as described above. The low $T_c$ for $CO_2$ means that an effective operating range for this medium will be 50-150° C. This is significantly lower than the temperatures required for thermal cracking of PAHs and asphaltenes into smaller volatile fractions, but significant advantage may be gained by a pre-hydrogenation step, as this will furnish a hydrogen-enriched substrate that will provide increased yields of upgraded materials in any subsequent cracking stage. PAHs like anthracene, phenanthrene, pyrene and perylene have been shown to be surprisingly soluble in $scCO_2$, and the fluid is an excellent hydrogenation medium. There is extensive literature on catalyzed organic hydrogenation reactions in $scCO_2$. Of specific interest is research carried out on highly unsaturated and aromatic substrates such as naphthalene and anthracene. Simple PAHs such as naphthalene, anthracene, pyrene and phenanthrene have been successfully hydrogenated to the corresponding hydrocarbon in conventional solvents using homogeneous metal carbonyl catalysts like $Mn_2(CO)_8(PBu_3)_2$, and $RuH_2(H_2)(PCy_3)_2$, although homogeneous hydrogenations usually require severe reaction conditions and are not widely reported. Heterogeneous conditions using a range of transition metal systems, including alumina-supported Pd and Pt, and a reduced $Fe_2O_3$ system are effective hydrogenation catalysts at reasonably low temperatures (<100° C.). Both naphthalene and anthracene have been hydrogenated with a supported Ru catalyst, and anthracene has been upgraded in this way using an active carbon-supported Ni catalyst. Of particular interest in this regard is a recent report describing the facile hydrogenation of naphthalene in $scCO_2$ in the presence of a supported Rh catalyst in 100% yield at the low temperature of 60° C. Homogeneous hydrogenation of heteroaromatic molecules such as benzothiophene (S containing) and indole (N containing) has been successfully demonstrated with a variety of simple catalysts at reasonable temperatures (<100° C.), with no poisoning of the catalysts by the heteroatom components. Photolysis of benzo[α]pyrene, chrysene and fluorene has been carried out in a water/ethanol mixture in the presence of oxygen to form a variety of ring opening products. There are few reports of photochemical transformations carried out in SCFs; however the transparency of $CO_2$ across much of the UV region of the spectrum allows substitution of ethanol with $scCO_2$ while still achieving similar photolysis results with PAHs in this medium.

Hexane, $C_6H_{14}$

Hexane offers an intermediate operating range (ca. 250-350° C.). Supercritical propane has been demonstrated as a direct extraction technology, and the recovery of bitumen from mined tar sands using a light hydrocarbon liquid is a patented technology. In the temperature regime of $scC_6H_{14}$, thermal rearrangement of the carbon skeleton becomes accessible. For example, alumina-supported noble metal catalysts have been used in the ring-opening of naphthalene and methylcyclohexane at 350° C., and substantial isomerization of the ring-opened products was observed. Homogeneous rhodium-catalyzed ring opening and hydrodesulfurization of benzothiophene has been shown to be successful at 160° C. with relatively low pressures of hydrogen (30 bar) in acetone and THF. The high concentrations of $H_2$ that can be supported in the SCF medium, in tandem with a heterogeneous hydrogenation co-catalyst (q.v.), is likely to result in simultaneous hydrogenation of ring-opened intermediates and their isomers, breaking up the high molecular weight unsaturated aromatic molecules and turning them into volatile aliphatic materials.

Water, $H_2O$

Supercritical $H_2O$ ($scH_2O$) has found utility in promoting a wide range of organic reactions, including hydrogenation and dehydrogenation; C—C bond formation and breaking; hydrolysis; and oxidation. Hydrogenation of simple PAHs and heteroaromatic hydrocarbons in the presence of sulfur-pretreated $NiMo/Al_2O_3$ catalysts has been demonstrated in $scH_2O$ at 400° C. This medium possesses properties very different from those of ambient-temperature water, including a decreased dielectric constant, a diminished degree of hydrogen bonding and an enhanced (by three orders of magnitude) dissociation constant. Accordingly, many organic compounds are highly soluble in $scH_2O$, and the pure fluid is an excellent environment for acid- and base-catalyzed reactions. $SCH_2O$ has recently been shown to act as an effective medium for the gasification of biomass derived from lignin, glucose and cellulose, because at temperatures around 400° C. major degradation and reorganization of the carbon skeleton occurs. Thus, pyrolysis in the presence of high amounts of dissolved $H_2$ and a Ni or Ru catalyst leads to a range of volatile products such as CO, $CO_2$ and $CH_4$. This represents a significant improvement over conventional gasification procedures, which operate at 700-1000° C. Hydrogenations of simple PAHs and heteroaromatic hydrocarbons in the presence of sulfur pretreated $NiMo/Al_2O_3$ catalysts have also been shown to be successful in $scH_2O$ at 400° C.

In principle, carbon dioxide, hexane and water as supercritical fluid reaction media are capable of integration with an extraction technology: $scCO_2$ has been demonstrated as an effective medium for the extraction of bitumen from tar sand and oil shale deposits; sc propane has been used to extract bitumen from oil sands, and the outflow from current CSS, SAGD or VAPEX extraction technologies may be easily converted into a supercritical bitumen-water mixture. Use of $scH_2O$ appears to be unexplored in tar sands technologies.

Catalysts

The enhanced miscibility of $H_2$ with $scCO_2$ has found a wide range of applications in homogeneous catalysis, including enantioselective preparation of fine chemicals like the herbicide (S)-metolaclor by Novartis. Facile hydroformylation of propene using a $CO_2(CO)_8$ catalyst has also been demonstrated, and an enhanced selectivity for the linear product n-butyraldehyde was observed compared with a conventional liquid solvent. Olefin metathesis, involving the breaking and rearrangement of C=C bonds, has been demonstrated in SCF media under mild conditions. A range of heterogeneous hydrogenation reactions has also been carried out successfully in $scCO_2$, including Fischer-Tropsch synthesis using a $Ru/Al_2O_3$ or a $Co/La/SiO_2$ catalyst system. Heterogeneous Group 8 metal catalysts are also very effective in the synthesis of N,N-dimethylformamide from $CO_2$, $H_2$ and $Me_2NH$ under supercritical conditions, and the hydrogenation of unsaturated ketones using a supported Pd catalyst has been carried out under mild conditions in $scCO_2$.

Oil, tar or bituminous material from oil sand or oil shale deposits can be extracted using a supercritical or near-critical solvent. The solubility of bitumen in supercritical $CO_2$ and supercritical hexane can be increased, and subsequently its extraction from tar sands can be enhanced by adding modifiers such as toluene or methanol and by using sonication to encourage dissolution. Sonication has recently been claimed to accelerate chemical reactions in a supercritical fluid medium.

In one embodiment of the invention, carbon dioxide is used as a supercritical medium for the combined extraction and upgrading process. Carbon dioxide has the most accessible critical temperature and is cheap, but lacks polarity and will be limited to a low temperature upgrading process. Modifiers such as toluene or methanol can be added to help dissolve bituminous material.

In another embodiment of this invention, hexane is used as a supercritical medium for the combined extraction and upgrading process. It offers a medium temperature possibility, but also suffers from the lack of a dipole moment and is the most costly of the three medium.

In another embodiment of this invention, water is used as a supercritical medium for the combined extraction and upgrading process. Water has the highest critical temperature. The polar nature and negligible cost of water are attractive characteristics.

An appropriate amount of hydrogen gas is introduced into this supercritical or near-critical mixture. The appropriate amount of hydrogen gas will vary according to the amount of unsaturation present in the hydrocarbon to be upgraded, and in relation to the proportion of hydrogen that is desired to be maintained in the reaction medium.

Hydrogenation and ring-opening reactions of simple PAHs like naphthalene and anthracene, and of more complex PAHs, including mixtures of PAHs containing heteroatoms like N and S, and transition metals, are conducted in these SCF media using a wide range of catalysts. Such mixtures are representative of the chemical constitution of bitumen and shale oil.

A number homogeneous and heterogeneous catalysts may be used with PAH substrates for a combination of hydrogenation and ring opening reactions in $scC_6H_{14}$, and cleavage, hydrogenation and gasification in $scH_2O$. These homogeneous catalysts include Nb and Ta, which have been shown to be effective for the hydrogenation of a variety of arene substrates. Heterogeneous supported systems are likely to prove more robust and long-lived than homogeneous catalysts. For $scCO_2$, there is a wide range of commercially available hydrogenation catalysts including heterogeneous Ni and Ru systems supported on alumina or carbon, and metals like Rh and Pt that can be costly.

Small amounts of co-solvents like n-butane and methanol can also be added to the $scCO_2$ medium to enhance the solubility of PAHs in $scCO_2$.

The reaction mixture can be activated by photochemical irradiation using light in the ultraviolet and/or visible region of the electromagnetic spectrum. This activation can be used to accelerate the ring-opening, fragmentation and hydrogenation reactions involved in the upgrading process.

Only the most robust catalysts will be compatible with the reactive and/or high temperature environment in $scC_6H_{14}$ and $scH_2O$. However, $\alpha$-$Al_2O_3$, $HfO_2$ and $ZrO_2$ are all physically and chemically stable under these conditions, and can be used to support finely divided metal catalysts. Late transition metals like Fe, Ni, Ru, Rh, Pd and Pt are effective hydrogen transfer catalysts to unsaturated organic moieties including the aromatic rings of PAHs, whereas Ru and Ir are known to be good catalysts for ring-opening and olefin metathesis.

Development of an optimal heterogeneous supported catalyst that combines these two processes under supercritical conditions is an iterative process necessitating a combinatorial approach at the outset. However, the simple expedient of e.g. impregnating $Al_2O_3$ with stock solutions of metal salts, followed by drying and reduction with $H_2$ gas is remarkably effective in producing high activity catalysts for these types of processes.

The reaction mixture is maintained at an appropriate temperature for an appropriate length of time to effect the desired hydrogenation, rearrangement, or degradation of the bituminous material in the mixture. The required temperature and length of time will vary depending on the concentration of reagents in the system and the quantity of material that one wishes to upgrade.

The following examples are intended to be illustrative of embodiments of the present invention. Those of skill in the art may effect alterations, modifications and variations to the particular embodiments without departing from the scope of the invention, which is set forth in the claims.

EXAMPLE #1

Hydrogenation of naphthalene, a PAH, was carried out in the presence of Rh/C with $H_2$ (60 bar, 870 psi) and $scCO_2$ (100 bar, 1450 psi). Reactions were carried out for 16 hours according to the reaction conditions shown in Scheme 1.

Scheme 1

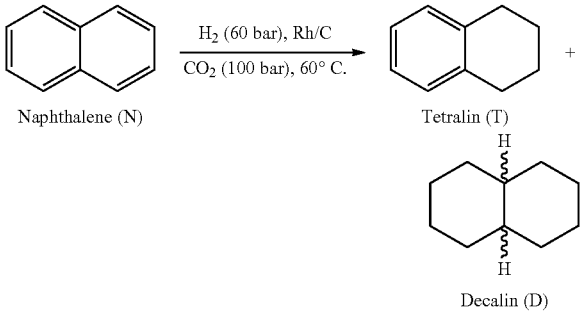

Figure 2:
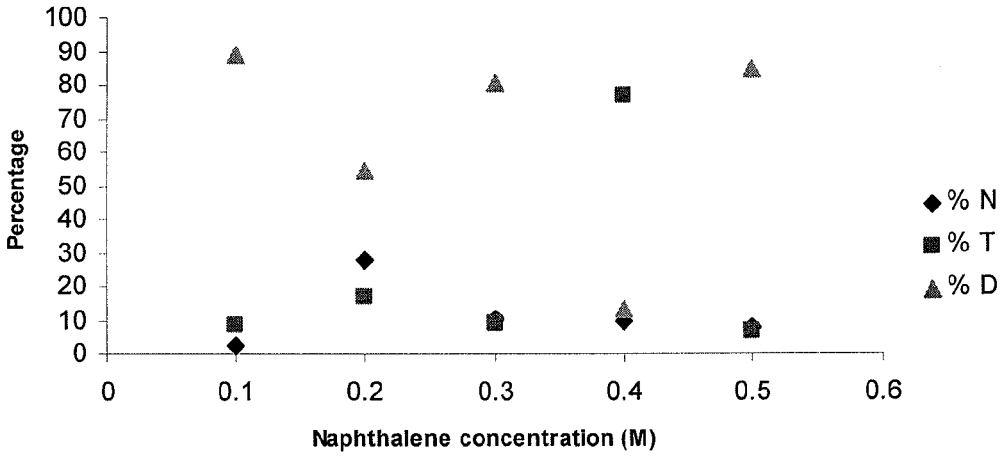
FIG. 2 is a graph showing hydrogenation of naphthalene as a function of initial concentration of naphthalene according to one embodiment of the invention.

FIG. 2 is a graph showing hydrogenation of naphthalene as a function of initial concentration of naphthalene, in which the amount of naphthalene is indicated by diamonds, the amount of tetralin is indicated by squares, and the amount of decalin is indicated by triangles. The vertical axis represents relative concentration of hydrocarbon in percent total hydrocarbon, and the horizontal axis represents initial concentration of naphthalene in moles.

The reaction was repeated using naphthalene concentrations of 0.1 M, 0.2 M, 0.3 M, 0.4 M, and 0.5 M. Under these reaction conditions, total hydrogenation of naphthalene was achieved at concentrations greater than 0.1 M. The result at 0.4 M is possibly due to errors associated with new equipment.

EXAMPLE #2

Figure 3:
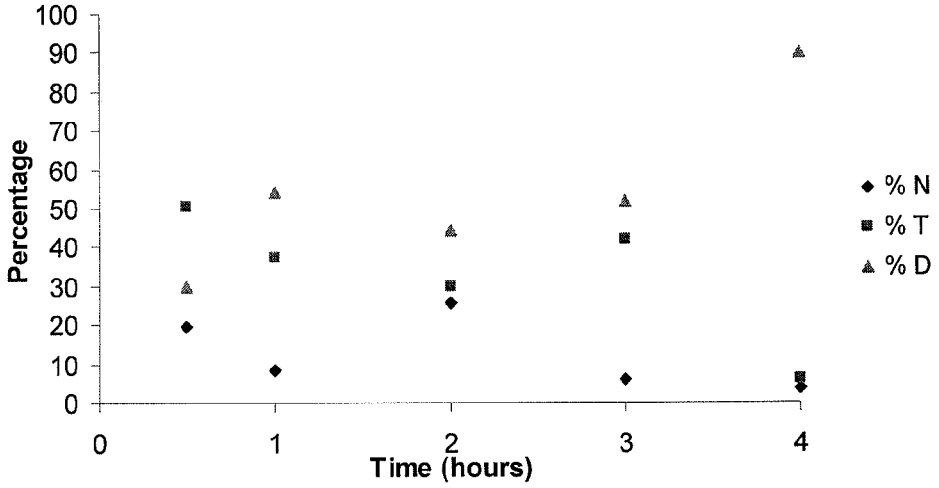
FIG. 3 is a graph showing the hydrogenation of naphthalene as a function of time according to one embodiment of the invention.

Hydrogenation of naphthalene, a PAH, was carried out by mixing 0.1 M naphthalene in the presence of Rh/C with $H_2$ (60 bar, 870 psi) and $scCO_2$ (100 bar, 1450 psi) at 60° C. The percentage of tetralin and decalin formed was analyzed at 30 minutes, 1 hour, 2 hours, 3 hours and 4 hours. FIG. 3 is a graph showing the hydrogenation of naphthalene as a function of time, in which the amount of naphthalene is indicated by diamonds, the amount of tetralin is indicated by squares, and the amount of decalin is indicated by triangles. The vertical axis represents relative concentration of hydrocarbon in percent total hydrocarbon, and the horizontal axis represents duration of the reaction process in units of hours.

As indicated in FIG. 3, 80% of naphthalene was converted to tetralin (50%) and decalin (30%) within 30 minutes. As the reaction time increased, naphthalene decreased further and formations of products increased. After 4 hours 90% of naphthalene had been converted to fully saturated decalin. Therefore, it is believed that only about 4 hours is required for complete hydrogenation, rather than 16 hours.

While the present invention has been particularly shown and described with reference to the structure and methods disclosed herein and as illustrated in the drawings, it is not confined to the details set forth and this invention is intended to cover any modifications and changes as may come within the scope and spirit of the following claims.

What is claimed is:

1. A process for extracting and upgrading a hydrocarbon comprising the steps of:

providing a substrate containing a hydrocarbon comprising at least one of oil, tar and bituminous material to be extracted and upgraded;

providing a reaction medium comprising hydrogen gas, a catalyst, and carbon dioxide as a supercritical or near-critical solvent that serves to extract said at least one of oil, tar and bituminous material from the substrate, and that serves to dissolve the hydrogen gas;

mixing the substrate, the supercritical or near-critical solvent, the hydrogen gas, and the catalyst; and maintaining the mixture at temperature sufficient to cause reaction for a length of time calculated to allow said reaction to proceed to a desired extent;

whereby said at least one of oil, tar and bituminous material is extracted and upgraded in a unitary operation.

2. The process of claim 1, further comprising the step of providing a modifier.

3. The process of claim 2, wherein the modifier is toluene or methanol.

4. The process of claim 1, further comprising the step of sonication.

5. The process of claim 1, further comprising the step of photochemical activation.

6. The process of claim 1, wherein the hydrocarbon comprises at least one of bitumen and polycyclic aromatic hydrocarbon (PAH).

7. The process of claim 1, wherein the substrate comprises at least one of oil sand, oil shale deposits, and tar sand.

8. The process of claim 6, wherein the PAH comprises at least one of naphthalene, anthracene, phenanthrene, pyrene, perylene, benzothiophene and indole.

9. The process of claim 6, wherein the PAH contains nitrogen, sulfur, or a transition metal.

10. The process of claim 1, wherein the catalyst comprises at least one of $Mn_2(CO)_8(PBu_3)_2$, $RuH_2(H_2)(PCy_3)_2$, Pd, Pt, Ru, Ni, Rh, Nb, and Ta.

11. The process of claim 1, further comprising the step of providing a co-solvent.

12. The process of claim 11, wherein the co-solvent is a selected one of n-butane and methanol.

13. The process of claim 1, wherein the catalyst is a selected one of $\alpha$-$Al_2O_3$, $HfO_2$, $ZrO_2$, NiMo, Fe, Ni, Ru, Rh, Pd, Pt, and Ir.

14. The process of claim 1, wherein the step of maintaining the mixture at temperature sufficient to cause reaction comprises maintaining the mixture at a temperature in the range of 50° C. to 400° C.

15. The process of claim 1, wherein the step of maintaining the mixture at temperature sufficient to cause reaction comprises maintaining the mixture at a temperature in the range of 50° C. to 150° C.

16. The process of claim 1, wherein the step of maintaining the mixture at temperature sufficient to cause reaction comprises maintaining the mixture at a temperature in the range of 250° C. to 350° C.

17. The process of claim 1, wherein the step of providing a reaction medium comprising hydrogen gas, a catalyst, and a supercritical or near-critical solvent comprises providing said supercritical or near-critical solvent at a pressure in the range of 50 bar to 1000 bar.

18. The process of claim 1, wherein the step of providing a reaction medium comprising hydrogen gas, a catalyst, and a supercritical or near-critical solvent comprises providing said supercritical or near-critical solvent at a pressure in the range of 100 bar to 500 bar.

19. The process of claim 1, wherein the step of providing a reaction medium comprising hydrogen gas, a catalyst, and a supercritical or near-critical solvent comprises providing said supercritical or near-critical solvent at a pressure in the range of 150 bar to 400 bar.

* * * * *